US010502371B2

(12) United States Patent
Hu et al.

(10) Patent No.: US 10,502,371 B2
(45) Date of Patent: Dec. 10, 2019

(54) LED-LAMP

(71) Applicant: LEDVANCE GmbH, Garching bei München (DE)

(72) Inventors: Jin Hu, Shenzhen Guangdong (CN); Tianzheng Jiang, Shenzhen Guangdong (CN); Bernhard Rieder, Regensburg (DE); Yonggang Xiao, Shenzhen Guangdong (CN)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 16/148,248

(22) Filed: Oct. 1, 2018

(65) Prior Publication Data

US 2019/0101248 A1 Apr. 4, 2019

(30) Foreign Application Priority Data

Sep. 30, 2017 (CN) ..... 2017 1 09156593

(51) Int. Cl.

| | |
|---|---|
| ***F21K 9/275*** | (2016.01) |
| ***F21K 9/272*** | (2016.01) |
| ***F21K 9/278*** | (2016.01) |
| ***F21V 29/503*** | (2015.01) |
| ***F21K 9/64*** | (2016.01) |
| ***F21Y 103/10*** | (2016.01) |
| ***F21Y 115/10*** | (2016.01) |

(52) U.S. Cl.

CPC ..... *F21K 9/275* (2016.08); *F21K 9/272* (2016.08); *F21K 9/278* (2016.08); *F21K 9/64* (2016.08); *F21V 29/503* (2015.01); *F21Y 2103/10* (2016.08); *F21Y 2115/10* (2016.08)

(58) Field of Classification Search

CPC ..... F21K 9/275; F21K 9/272; F21K 9/64; F21K 9/278; F21V 29/503; F21Y 2103/10; F21Y 2115/10

See application file for complete search history.

(56) References Cited

U.S. PATENT DOCUMENTS

| | | | | |
|---|---|---|---|---|
| 8,400,051 | B2 * | 3/2013 | Hakata | H01L 25/0753 313/110 |
| 10,039,165 | B2 * | 7/2018 | Qiu | F21V 23/04 |
| 10,281,129 | B1 * | 5/2019 | Lai | F21V 29/503 |
| 2003/0102810 | A1 * | 6/2003 | Cross | H05B 33/0803 315/74 |
| 2012/0104418 | A1 * | 5/2012 | Lin | H01L 33/507 257/88 |
| 2013/0141892 | A1 * | 6/2013 | Okazaki | F21V 3/00 362/84 |
| 2013/0279160 | A1 * | 10/2013 | Myers | F21V 19/001 362/224 |
| 2014/0009068 | A1 * | 1/2014 | Ivey | H05B 33/0854 315/152 |
| 2014/0009926 | A1 * | 1/2014 | Simon | F21V 17/12 362/222 |

(Continued)

*Primary Examiner* — Joseph L Williams
*Assistant Examiner* — Jose M Diaz
(74) *Attorney, Agent, or Firm* — Hayes Soloway PC

(57) ABSTRACT

The lamp includes a substantially transparent housing tube, a first end cap at a first end of the housing tube and a second end cap at a second end of the housing tube. The end caps include contacts for electrically contacting a power supply. An LED-filament is arranged in the housing tube between the first end cap and the second end cap.

20 Claims, 5 Drawing Sheets

(56) References Cited

U.S. PATENT DOCUMENTS

| | | | | |
|---|---|---|---|---|
| 2014/0268727 | A1* | 9/2014 | Amrine, Jr. | F21V 3/02 362/224 |
| 2014/0362565 | A1* | 12/2014 | Yao | H01L 25/0753 362/223 |
| 2014/0369036 | A1* | 12/2014 | Feng | F21K 9/23 362/223 |
| 2015/0204487 | A1* | 7/2015 | Scapa | F21V 23/006 362/222 |
| 2015/0334790 | A1* | 11/2015 | Scapa | H05B 33/08 315/294 |
| 2016/0091179 | A1* | 3/2016 | Jiang | F21V 19/009 362/218 |
| 2016/0123571 | A1* | 5/2016 | Chan | F21V 29/83 362/249.01 |
| 2016/0348851 | A1* | 12/2016 | Amrine, Jr. | F21V 23/023 |
| 2017/0318637 | A1* | 11/2017 | Qiu | F21V 23/04 |
| 2018/0031185 | A1* | 2/2018 | Pettmann | F21K 9/27 |

* cited by examiner

LED-LAMP

CROSS-REFERENCE TO RELATED APPLICATIONS AND PRIORITY

This patent application claims priority from Chinese Patent Application No. 2017109156593 filed Sep. 30, 2017, which is herein incorporated by reference in its entirety.

TECHNICAL FIELD

The present invention relates to a lamp, in particular an LED-Lamp, more particular to a double ended LED-retrofit-lamp for replacing an R7S double ended linear halogen lamp.

BACKGROUND

It has been known to use double ended linear halogen lamps in many kinds of luminaires due to their high luminous intensity and their substantially isotropic and omnidirectional radiation. However, halogen lamps comprise a low light efficiency, typically of about 10 to 20 lm/W. Thus, lamps having LEDs comprising a much higher light efficiency are utilized in many occasions to replace halogen lamps. As an example, it is known to replace R7S double ended linear halogen lamps by LED-lamps containing correspondingly shaped R7S bases.

LED-Lamps normally comprise a plurality of LEDs arranged in a pattern on a light engine which is in thermal conductive contact with a heat sink. Due to heat dissipation requirements, the heat sinks and thus the LED-lamps must have a certain size. In addition, LEDs have a narrow angel of radiation. Hence, the LEDs have to be arranged in different orientations to achieve high light radiation in different directions. Moreover, the light engine and the metal heat sink are non-transparent for light so that they further limit the possible angle of radiation of the LEDs. Thus, known LED lamps differ in shape in that their radial extension in general is much bigger than those of halogen lamps.

Furthermore, the appearance of known LED lamps hence differs significantly from the appearance of halogen lamps.

SUMMARY OF THE INVENTION

In view of the known prior art, it is an object of the present invention to provide an improved lamp for replacing a halogen lamp, preferably an LED-lamp, more preferably a double ended LED-retrofit-lamp.

This object is solved by a lamp according to the independent claim. Preferred embodiments are given by the dependent claims, the description and the figures.

Accordingly, a lamp is suggested, comprising a substantially transparent housing tube, a first end cap at a first end of the housing tube and a second end cap at a second end of the housing tube, wherein the end caps include contacts for electrically contacting a power supply. Furthermore, an LED-filament is arranged in the housing tube between the first end cap and the second end cap.

By arranging an LED-filament in the housing tube between the first end cap and the second end cap, the lamp can be formed smaller in size compared to known lamps since the heat sink for cooling may be waived. In addition, the outer appearance of the lamp may be adjusted to substantially match the outer appearance of a halogen lamp, in particular in size and shape.

Furthermore, by providing the LED-filament, compared to common lamps comprising a LED pattern arranged on an non-transparent substrate, the lamp comprises a much more omnidirectional radiation characteristic or directivity as the LED-filament comprises a subcardioid, nearly omnidirectional radiation characteristic.

The term "transparent" refers to any material which is in large parts permeable for light of at least a certain wavelength or wavelength region emitted by the LED-filament.

Preferably, the degree of transparency for the according light is greater than 0.5, 0.6, 0.7, 0.8, 0.9 or 0.92.

A "LED-filament" is shaped to look like the filament of an incandescent light bulb, thus, it comprises a thin, elongated shape. LED filaments comprise a base substrate on which a plurality of LED spots is arranged in series. At least the LED spots are covered with a fluorescence layer or cover, wherein the light emitted by the LEDs excites an active component of the fluorescence layer. Accordingly, the light emitted by the LED-filament is substantially determined by the fluorescent light emitted by the fluorescent layer.

According to a preferred embodiment, at least one driver for the LED-filament is provided, wherein preferably, a first driver is arranged at the first end cap and a second driver is arranged at the second end cap. Thus, each the first driver and the second driver may be formed smaller than a single driver. In addition, heat generated by the drivers may be split such that a more even distribution of heat is achieved over the length of the lamp.

For providing a particular evenly formed light radiation, that is, a particular omnidirectional radiation characteristic, and for an increased luminous power, according to another preferred embodiment, a plurality of LED-filaments is arranged between the first end cap and the second end cap, the LED-filaments being positioned substantially parallel to each other. In other words, the LED-filaments each comprise a longitudinal extension, wherein all LED-filaments are arranged with their longitudinal extensions oriented in the same direction, preferably in a direction of a central axis or spline of the lamp. Preferably, the LED-filaments are each arranged in a circumferential direction around a central axis or spline of the lamp, wherein each LED-filament preferably is positioned so that its maximum luminous intensity is oriented radially outwards with respect to the central axis or spline.

Preferably, the LED-filaments are positioned with an equal distance, hence, evenly distributed along the circumference. Thus, the arrangement of the plurality of the LED-filament substantially comprises the form of a cylinder.

A particularly slim form of the lamp may be achieved, when according to another preferred embodiment a plurality of housing tubes is arranged between the first end cap and the second end cap, wherein preferably each LED-filament is arranged in a separate housing tube. Thus, in case of damage of one LED-filament, other LED-filaments will not be influenced by particles or smoke which might be generated by the damaged LED-filament.

According to yet another preferred embodiment, the housing tube is substantially cylindrical. Thus, the lamp may comprise a form or appearance highly similar to a form appearance of a halogen lamp which is to be replaced by the lamp.

To provide excellent transparency, according to another preferred embodiment, the housing tube is made of glass.

According to yet another preferred embodiment, the LED-filament comprises a plurality of LED spots connected in series, preferably at least 10, 20, 25, 28, 30, 35, 40, 50, 75, 100 or more LED spots. Thus, it is possible to set the light power to a predetermined level according to the amount of LED spots on the filament.

According to yet another preferred embodiment, the LED-filament comprises a base substrate made of a glass or sapphire material. Thus, radiation is not influenced or blocked by the substrate.

For providing a broad light spectrum and for increasing the angle or radiation as well as for providing subcardioid or even substantially omnidirectional radiation characteristics of the LED-filament, according to yet another preferred embodiment the LED-filament comprises a fluorescence layer, wherein preferably the fluorescence layer comprises an active component, preferably yttrium aluminum garnet, preferably cerium (Ce)-doped yttrium aluminum garnet and/or a phosphor, preferably yellow phosphor, and preferably a silicone resin binder material.

Preferably, the color temperature of the LED-filaments is determined by the ratio of blue and red LED spots that are distributed on the LED-filament, as well as the composition of the fluorescent layer. In contrast to conventional LEDs on an opaque substrate, LED-filaments have a similar radiation characteristic as a classic incandescent filament such as a halogen lamp, that is, they comprise almost omnidirectional radiation characteristics.

For enabling an electrical connection between the first end cap and the second end cap, according to another preferred embodiment, a connection unit for electrical connection between the first end cap and the second end cap is provided between the first end cap and the second end cap, wherein the connection unit preferably comprises at least two wires which preferably are burned in a glass substrate.

To provide enhanced heat dissipation from the LED-filament, according to yet another preferred embodiment, a high thermal conductivity gas for heat dissipation from at least one LED-filament, preferably Helium, is provided in at least one housing tube.

A particularly beneficial form of the lamp may be achieved when the first end cap and the second end cap comprise the form of an R7s lamp base.

According to another preferred embodiment, the lamp is configured to replace an R7S double ended linear halogen lamp. With other words, the lamp may be a so called retrofit lamp which may be used for replacing an ordinary incandescent light lamp such as a R7S double ended linear halogen lamp.

A particularly beneficial form of the lamp is achieved when a radial extension of the lamp is equal to or smaller than 12 mm. Thus, the lamp is thin or slim enough to fit for any application where ordinary R7S lamps are used.

For ensuring that the lamp fits into the sockets of ordinary lamps which shall be replaced by the lamp, a total length of the lamp may be 78 mm, 118 mm, 189 mm, 254 mm, 327 mm or 331 mm.

According to yet another preferred embodiment, the lamp is substantially made of a transparent material, preferably a glass material. That is, all components or parts of the lamp apart from the LED spots, the drivers and the parts for enabling electrical connection are made of a transparent material, preferably glass. Thus, shadowing of the light emitted by the at least one LED-filament is reduced to a minimum.

BRIEF DESCRIPTION OF THE DRAWINGS

Preferred embodiments of the invention will be explained in the following, having regard to the drawings. It is shown in.

DETAILED DESCRIPTION OF THE INVENTION

In the following, preferred embodiments of the invention will be described with reference to the drawings. The same or similar elements or elements having the same effect may be indicated by the same reference number in multiple drawings. Repeating the description of such elements may be omitted in order to prevent redundant descriptions.

Figure 1:
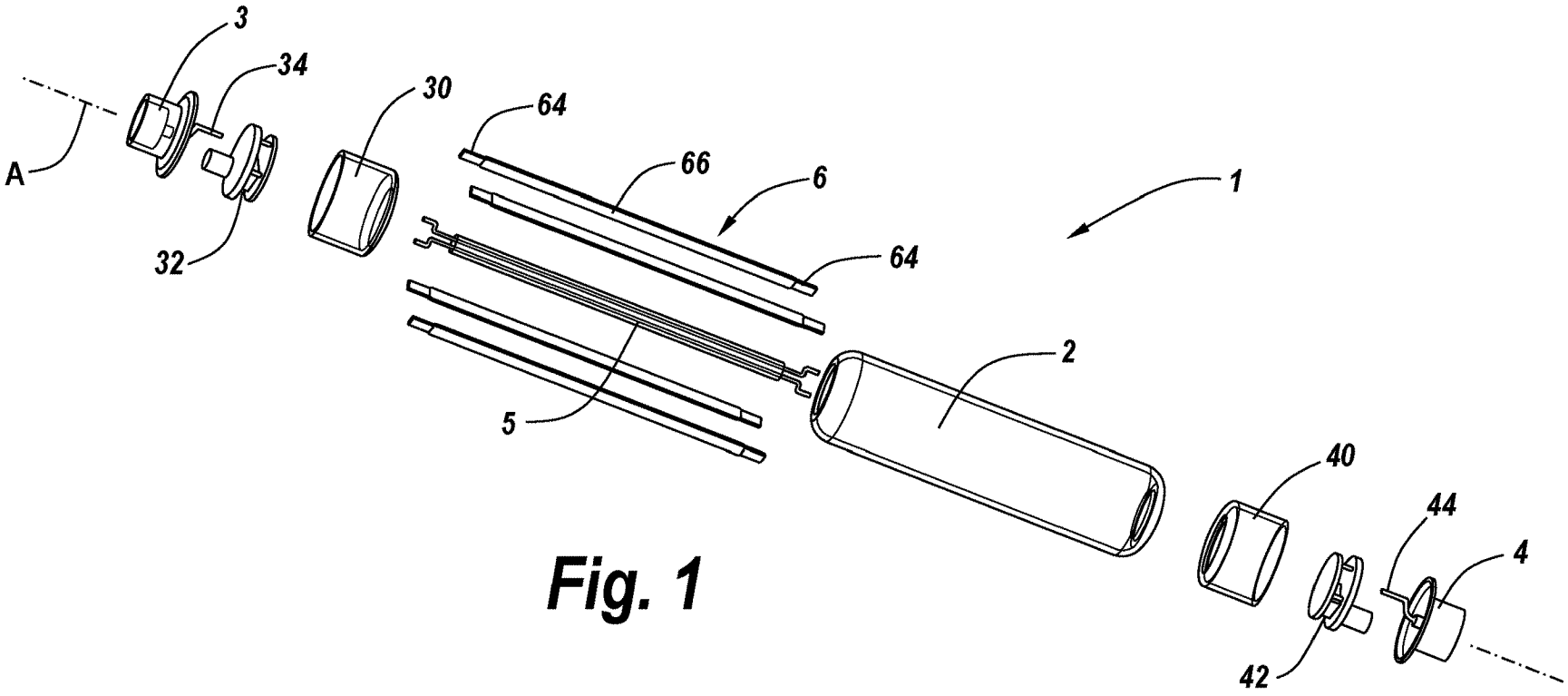
FIG. 1 schematically an exploded perspective view of a lamp according to a first embodiment.

FIG. 1 shows schematically an exploded perspective view of a lamp 1 according to a first embodiment. The lamp 1 comprises a substantially cylindrical housing tube 2 made of glass. On a first end of the housing tube 2, a first end cap 3 is arranged. The first end cap 3 comprises a receptacle 30 for retaining a first driver 32. Opposite to the first end cap 3 on a second end of the housing tube 2, a second end cap 4 comprising a receptacle 40 for retaining a second driver 42 is arranged. The end caps 3, 4 each comprise the form of an R7S base. Thus, the end caps 3, 4, enable electrical connection with a correspondingly shaped R7S socket (not shown). For this instance, the end caps 3, 4 comprise wires 34, 44 which are in electrical connection with the respective drivers 30, 40, and with a connection unit 5 comprising two wires (not shown) which are burned into a glass substrate of the connection unit 5. The connection unit 5 provides electrical connection between the first end cap 3 and the second end cap 4 and thus the drivers 32, 42.

Furthermore, four LED-filaments 6 are arranged between the first end cap 3 and the second end cap 4, the LED-filaments 6 being positioned substantially parallel to each other in a circumferential direction with respect to a central axis A of the lamp 1 and being evenly spaced apart from each other. Each LED-filament 6 comprises a base substrate made of glass or a sapphire material on which a plurality of LED spots are arranged and connected in series. Furthermore, each LED-filament comprises a fluorescence layer 66 covering the LED spots. The fluorescence layer comprises an active component which can be excited to fluoresce by light emitted by the LED spots.

In this embodiment, the fluorescence layer comprises cerium (Ce)-doped yttrium aluminum garnet and a silicone resin binder material. However, it is not limited thereto but may also alternatively or additionally comprise any other material suitable for providing the fluorescence layer.

The color temperature of the LED-filaments 6 is determined by the ratio of blue and red LED spots that are distributed on each LED-filament 6 and the composition of the fluorescent layer 66. Due to the fluorescence layer 66, the LED-filaments 6 each comprise almost omnidirectional radiation characteristics.

For electrical connection to the drivers 32, 42, the LED-filaments comprise electrical contacts 64 at their ends.

The housing tube 2 is at least transparent for a part of the wavelength spectrum of the light emitted by the LED-filaments 6, wherein in this embodiment, the housing tube 2 is transparent in the wavelength spectrum of visible light comprising a degree of transparence of about 0.9.

Figure 2:
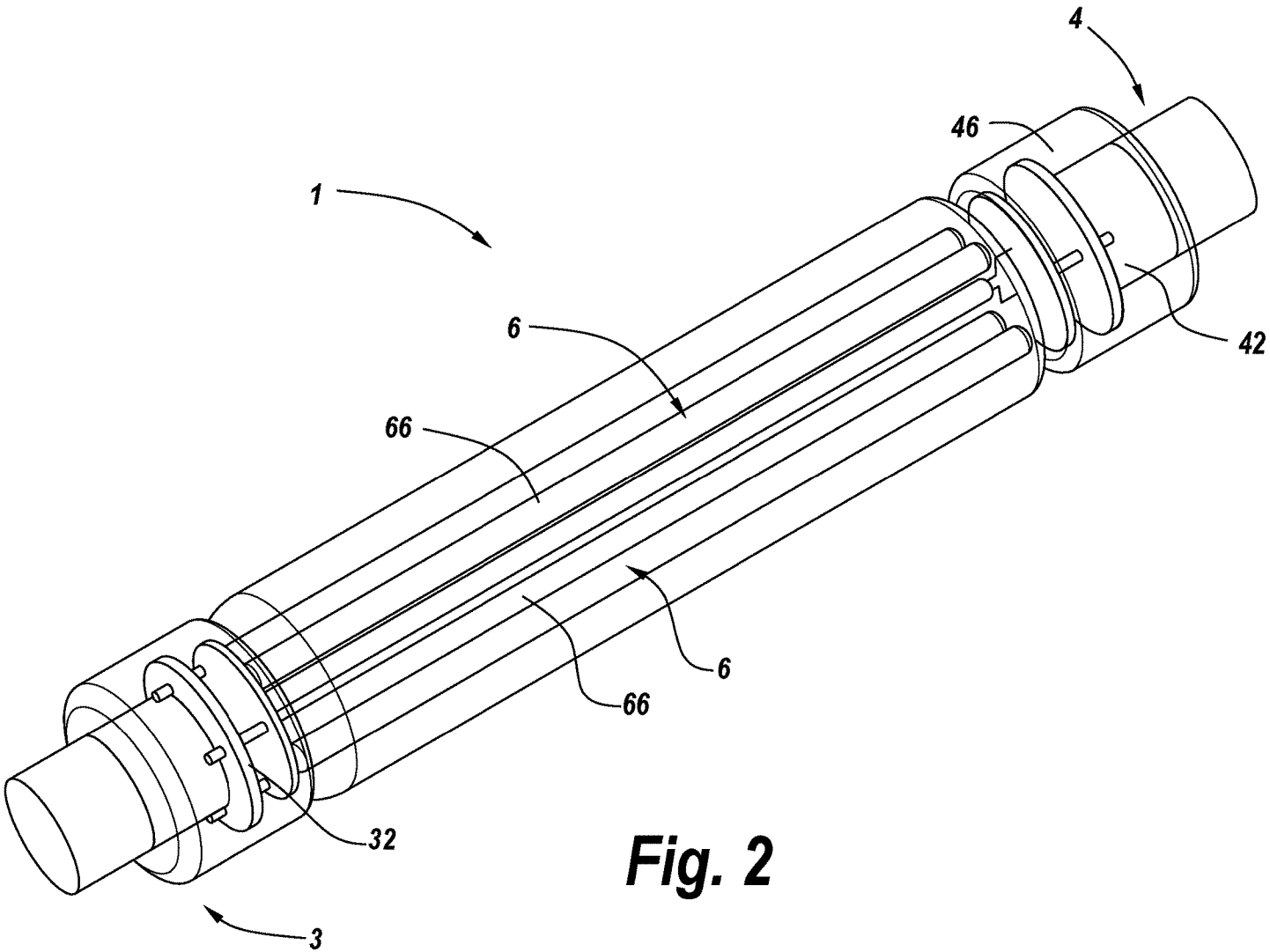
FIG. 2 schematically a perspective side view of the lamp according to the first embodiment in an assembled state.

In FIG. 2 a schematically perspective side view of the lamp 1 according to the first embodiment is shown in an assembled state. It can be clearly seen that the LED-filaments 6 are arranged in the housing tube 2. As the LED-filaments 6 generate significantly less heat during operation compared to an LED-light comprising LEDs arranged in pattern on a light engine, the housing tube 2 is merely filled with air for heat dissipation. Alternatively, the housing tube 2 may be filled with a high thermal conductivity gas for heat dissipation from the LED-filament 6, preferably Helium.

The lamp 1 is a retrofit lamp configured to replace an R7S double ended linear halogen lamp. Thus, its shape is substantially similar to an ordinary R7S incandescent light lamp.

To ensure that the lamp 1 is suitable for various applications, the lamp 1 comprises a radial extension of 12 mm. Thus, it is thin enough to fit in any installation space which used to be designated for use of R7S double ended halogen lamps.

In the first embodiment, all components and parts of the lamp 1 apart from the LED spots, the drivers 32, 42 and the parts for enabling electrical connection such as the wires 34, 44 and the connection unit 5 are made of a transparent material. Thus, shadowing of the light emitted by the LED-filaments 6 is reduced to a minimum.

Figure 3:
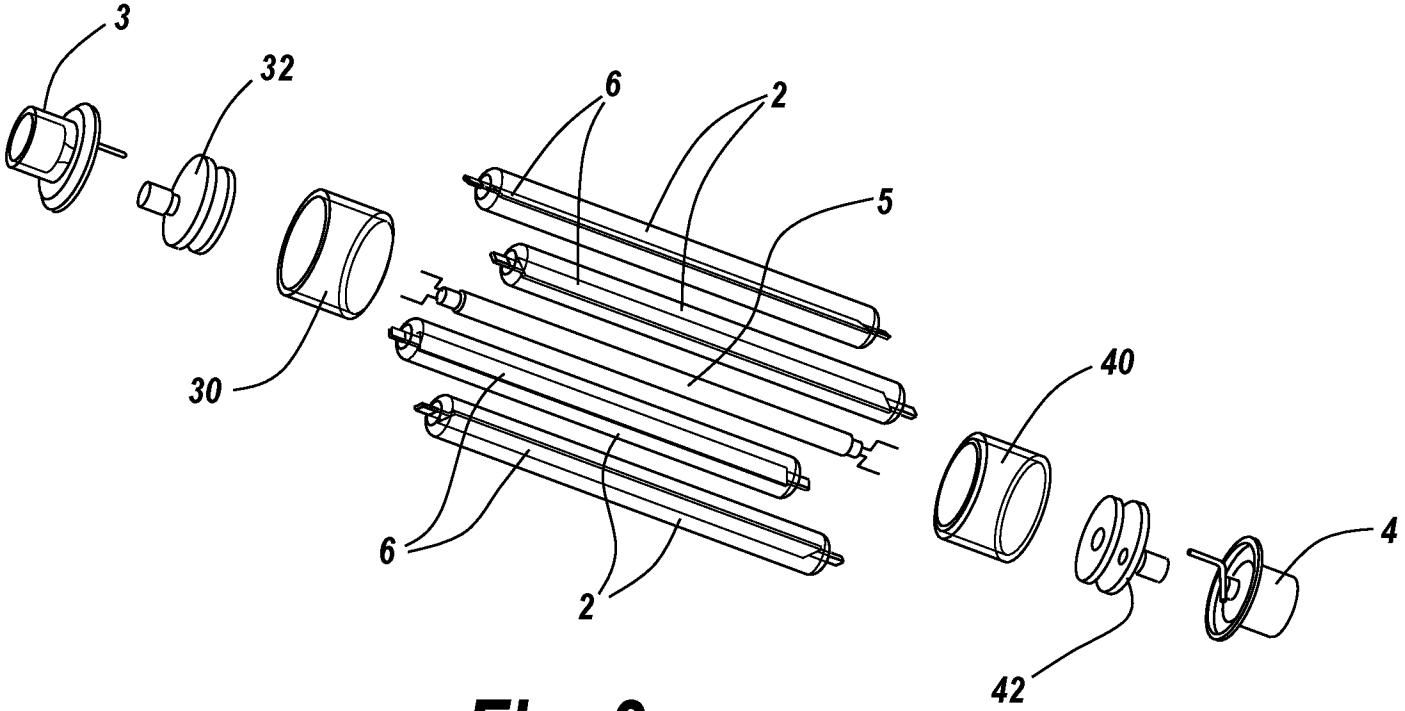
FIG. 3 schematically an exploded perspective view of a lamp according to a second embodiment.

FIG. 3 shows schematically an exploded perspective view of a lamp 1 according to a second embodiment. The structure of the lamp 1 is substantially similar to the structure of the lamp 1 shown in FIGS. 1 and 2, wherein in the embodiment according to FIG. 3, each LED-filament 6 is arranged inside a separate housing tube 2. Each housing tube 2 comprises a diameter slightly larger than the maximum radial extension of the corresponding LED-filament 6.

Figure 4:
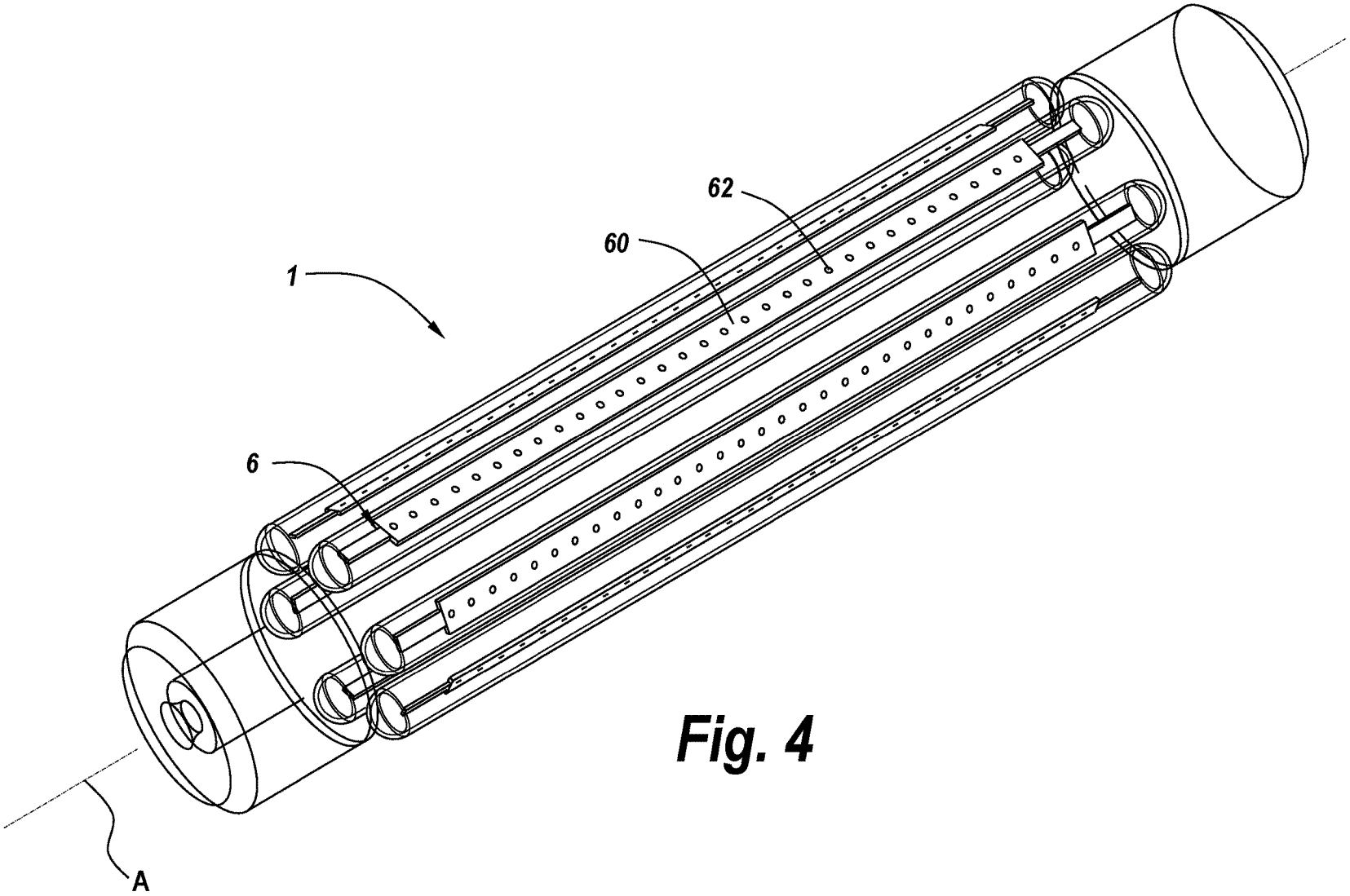
FIG. 4 schematically a perspective side view of the lamp according to the second embodiment in an assembled state.

A schematically perspective side view of the lamp according to the second embodiment in an assembled state can be taken from FIG. 4, wherein the fluorescence layer of the LED-filaments 6 is not shown such that the base substrate 60 and the plurality of LED spots 62 arranged on the base substrate 60 are visible. The LED spots 62 are evenly arranged on the base substrate 60 so that an even light intensity is provided over the whole length of each LED-filament 6. For enabling a maximum radial radiation of the lamp, each LED-filament 6 is arranged such that its LED spots 62 are positioned to radiate radially outwards with respect to a central spline or axis A with its maximum luminous intensity.

Figure 5:
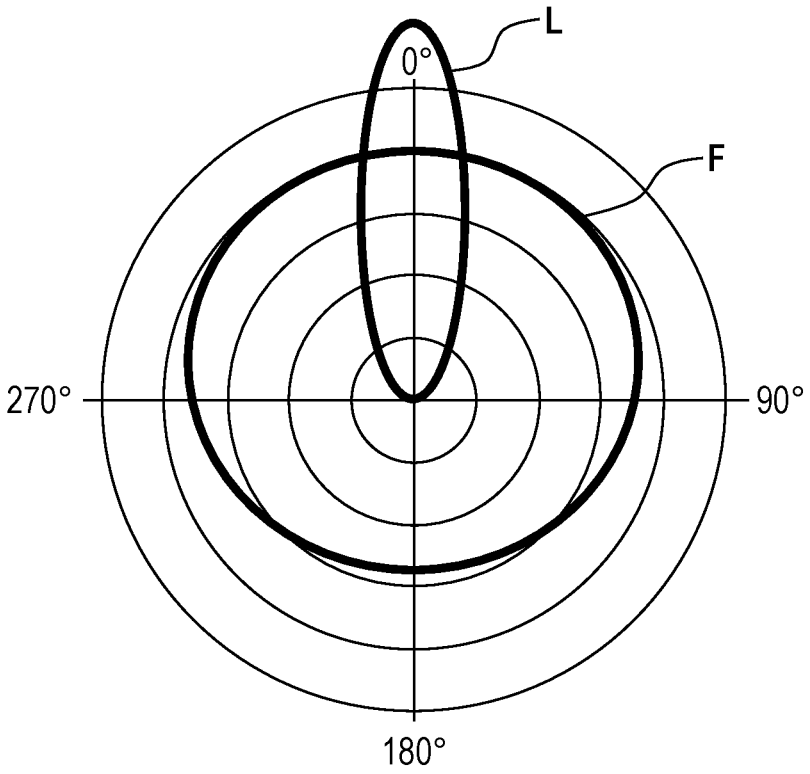
FIG. 5 schematically the luminous intensity in view of the angle of radiation of a LED-filament and a conventional LED.

FIG. 5 shows schematically the luminous intensity in view of the angle of radiation, wherein the luminous intensity of a LED-filament is indicated via reference sign F and the luminous intensity of a conventional LED is indicated via reference sign L. As can be clearly seen, the conventional LED has merely a very limited angle of radiation and the LED-filament 6 comprises a subcardioid radiation characteristic.

Although the invention has been illustrated and described in detail by the embodiments explained above, it is not limited to these embodiments. Other variations may be derived by the skilled person without leaving the scope of the attached claims.

Generally, "a" or "an" may be understood as singular or plural, in particular with the meaning "at least one", "one or more", etc., unless this is explicitly excluded, for example by the term "exactly one", etc.

In addition, numerical values may include the exact value as well as a usual tolerance interval, unless this is explicitly excluded.

Features shown in the embodiments, in particular in different embodiments, may be combined or substituted without leaving the scope of the invention.

LIST OF REFERENCE NUMERALS

1 lamp
2 housing tube
3 first end cap
30 receptacle
32 first driver
34 wire
4 second end cap
40 receptacle
42 first driver
44 wire
5 connection unit
6 LED-filament
60 substrate
62 LED spot
64 electrical contact
66 fluorescence layer
A axis
R radial direction
F radial luminous intensity of LED-filament
L radial luminous intensity of conventional LED

The invention claimed is:

1. A lamp comprising:
a substantially transparent housing tube;
a first end cap at a first end of the housing tube;
a second end cap at a second end of the housing tube, wherein the end caps include contacts for electrically contacting a power supply; and
a light emitting diode (LED)-filament arranged in the housing tube between the first end cap and the second end cap;
wherein at least one driver for the LED-filament is provided, wherein a first driver is arranged at the first end cap and a second driver is arranged at the second end cap.

2. The lamp according to claim 1, wherein a plurality of LED-filaments is arranged between the first end cap and the second end cap, the LED-filaments being positioned substantially parallel to each other.

3. The lamp according to claim 2, wherein a plurality of housing tubes is arranged between the first end cap and the second end cap, wherein each LED-filament is arranged in a separate housing tube.

4. The lamp according to claim 1, wherein the housing tube is substantially cylindrical.

5. The lamp according to claim 1, wherein the LED-filament comprises at least 10 LED spots connected in series, and wherein the LED-filament comprises a base substrate made of a glass or sapphire material.

6. The lamp according to claim 1, wherein the LED-filament comprises a fluorescence layer, wherein the fluorescence layer comprises:
at least one of yttrium aluminum garnet, cerium (Ce)-doped yttrium aluminum garnet and a phosphor; and
a silicone resin binder material.

7. The lamp according to claim 1, wherein a connection unit for electrical connection is provided between the first end cap and the second end cap, wherein the connection unit comprises at least two wires which are burned in a glass substrate.

8. The lamp according to claim 1, wherein a high thermal conductivity gas for heat dissipation from at least one LED-filament is provided in the housing tube.

9. The lamp according to claim 1, wherein the first end cap and the second end cap comprise an R7S lamp base.

10. The lamp according to claim 1, wherein the lamp is configured to replace an R7S double-ended linear halogen lamp.

11. The lamp according to claim 1, wherein a radial extension of the lamp is equal to or smaller than 12 mm.

12. The lamp according to claim 1, wherein the housing tube is made of glass.

13. A lamp comprising:

a substantially transparent housing tube;

a first end cap at a first end of the housing tube;

a second end cap at a second end of the housing tube, wherein the end caps include contacts for electrically contacting a power supply; and a light emitting diode (LED)-filament arranged in the housing tube between the first end cap and the second end cap;

wherein a high thermal conductivity gas for heat dissipation from at least one LED-filament is provided in the housing tube.

14. The lamp according to claim 13, wherein a plurality of LED-filaments is arranged between the first end cap and the second end cap, the LED-filaments being positioned substantially parallel to each other.

15. The lamp according to claim 14, wherein a plurality of housing tubes is arranged between the first end cap and the second end cap, wherein each LED-filament is arranged in a separate housing tube.

16. The lamp according to claim 13, wherein the housing tube is substantially cylindrical.

17. The lamp according to claim 13, wherein the first end cap and the second end cap comprise an R7S lamp base.

18. The lamp according to claim 13, wherein the lamp is configured to replace an R7S double-ended linear halogen lamp.

19. The lamp according to claim 13, wherein a radial extension of the lamp is equal to or smaller than 12 mm.

20. The lamp according to claim 13, wherein the housing tube is made of glass.

* * * * *